United States Patent [19]

Yanus

[11] Patent Number: 4,486,520

[45] Date of Patent: Dec. 4, 1984

[54] PHOTOCONDUCTIVE DEVICES CONTAINING NOVEL SQUARAINE COMPOSITIONS

[75] Inventor: John F. Yanus, Webster, N.Y.

[73] Assignee: Xerox Corporation, Stamford, Conn.

[21] Appl. No.: 558,224

[22] Filed: Dec. 5, 1983

[51] Int. Cl.[3] ..... G03G 5/14

[52] U.S. Cl. ..... 430/59; 430/73; 430/900; 568/306

[58] Field of Search ..... 430/73, 57, 59; 568/306

[56] References Cited

U.S. PATENT DOCUMENTS

| | | | |
|---|---|---|---|
| 3,617,270 | 11/1971 | Kampfer et al. | 430/92 |
| 3,824,099 | 7/1974 | Champ et al. | 430/58 |
| 4,123,270 | 10/1978 | Heil et al. | 260/199 |
| 4,150,987 | 4/1979 | Anderson et al. | 430/58 |
| 4,353,971 | 10/1982 | Chang et al. | 430/58 |

OTHER PUBLICATIONS

Photographic Science & Engineering, vol. 27, No. 1, Jan./Feb. 1983, p. 5.

IBM TDB, No. 11B, vol. 24, 4/82.

*Primary Examiner*—John D. Welsh

*Attorney, Agent, or Firm*—E. O. Palazzo

[57] ABSTRACT

This invention is generally directed to fluorinated squaraine compositions of the formula:

wherein $R_1$, $R_2$, $R_3$, and $R_4$, are independently selected from alkyl groups, containing from about 1 to about 20 carbon atoms, and layered photoresponsive devices containing such compositions.

43 Claims, 8 Drawing Figures

PHOTOCONDUCTIVE DEVICES CONTAINING NOVEL SQUARAINE COMPOSITIONS

BACKGROUND

This invention is generally directed to novel squaraine compositions of matter, and the incorporation of these compositions into layered photoresponsive devices. In one embodiment the present invention is directed to the use of novel squaraine compositions of matter, as organic photoconductive materials in layered photoresponsive devices, especially those devices containing amine hole transport layers. More specifically there is provided in accordance with the present invention a photoresponsive device containing as a photoconductive layer novel fluorinated squaraine compositions of matter. The sensitivity of certain of these photoresponsive devices can be varied or enhanced, allowing them to be capable of being responsive to visible light, and infra-red illumination needed for laser printing. Accordingly a photoresponsive device containing the novel fluorinated squaraine compositions of the present invention can function so as to enhance or reduce the intrinsic properties of a charge carrier photogenerating material contained therein, in the infra-red and/or visible range of the spectrum thereby allowing the device to be sensitive to either visible light and/or infra-red wavelengths.

Numerous different xerographic photoconductive members are known including, for example, a homogeneous layer of a single material such as vitreous selenium, or a composite layered device, containing a dispersion of a photoconductive composition. An example of one type of composite xerographic photoconductive member is described for example, in U.S. Pat. No. 3,121,006, wherein there is disclosed finely divided particles of a photoconductive inorganic compound dispersed in an electrically insulating organic resin binder. These members contain for example coated on a paper backing a binder layer containing particles of zinc oxide uniformly dispersed therein. The binder materials disclosed in this patent comprise a material such as polycarbonate resins, polyester resins, polyamide resins, and the like which are incapable of transporting for any significant distance injected charge carriers generated by the photoconductive particles. Accordingly, as a result the photoconductive particles must be in a substantially contiguous particle to particle contact throughout the layer for the purpose of permitting charge dissipation required for a cyclic operation. Thus, with the uniform dispersion of photoconductive particles described a relatively high volume concentration of photoconductor material, about 50 percent by volume, is usually necessary in order to obtain sufficient photoconductor particle to particle contact for rapid discharge. This high photoconductive loading can result in destroying the physical continuity of the resinous binder, thus significantly reducing the mechanical properties thereof.

There are also known photoreceptor materials comprised of inorganic or organic materials wherein the charge carrier generating, and charge carrier transport functions are accomplished by discrete contiguous layers. Additionally, layered photoreceptor materials are disclosed in the prior art which include an overcoating layer of an electrically insulating polymeric material. However, the art of xerography continues to advance and more stringent demands need to be met by the copying apparatus in order to increase performance standards, and to obtain higher quality images. Also, there is desired layered photoresponsive devices which are responsive to visible light, and/or infrared illumination needed for laser printing.

Recently, there has been disclosed other layered photoresponsive devices including those comprised of separate generating layers, and transport layers as described in U.S. Pat. No. 4,265,990, and overcoated photoresponsive materials containing a hole injecting layer, overcoated with a hole transport layer, followed by an overcoating of a photogenerating layer, and a top coating of an insulating organic resin, reference U.S. Pat. No. 4,251,612. Examples of photogenerating layers disclosed in these patents include trigonal selenium, and phthalocyanines, while examples of transport layers include certain diamines as mentioned herein. The disclosures of each of these patents, namely, U.S. Pat. Nos. 4,265,990 and 4,251,612 are totally incorporated herein by reference.

Many other patents are in existence describing photoresponsive devices including layered devices containing generating substances, such as U.S. Pat. No. 3,041,167, which discloses an overcoated imaging member containing a conductive substrate, a photoconductive layer, and an overcoating layer of an electrically insulating polymeric material. This member is utilized in an electrophotographic copying method by, for example, initially charging the member, with an electrostatic charge of a first polarity, and imagewise exposing to form an electrostatic latent image which can be subsequently developed to form a visible image. Prior to each succeeding imaging cycle, the imaging member can be charged with an electrostatic charge of a second polarity, which is opposite in polarity to the first polarity. Sufficient additional charges of the second polarity are applied so as to create across the member a net electrical field of the second polarity. Simultaneously, mobile charges of the first polarity are created in the photoconductive layer such as by applying an electrical potential to the conductive substrate. The imaging potential which is developed to form the visible image, is present across the photoconductive layer and the overcoating layer.

There is also disclosed in Belgium Pat. No. 763,540, an electrophotographic member having at least two electrically operative layers, the first layer comprising a photoconductive layer which is capable of photogenerating charge carriers, and injecting the carriers into a continuous active layer containing an organic transporting material which is substantially non-absorbing in the spectral region of intended use, but which is active in that it allows the injection of photogenerated holes from the photoconductive layer and allows these holes to be transported through the active layer. Additionally, there is disclosed in U.S. Pat. No. 3,041,116, a photoconductive material containing a transparent plastic material overcoated on a layer of vitreous selenium contained on a substrate.

Furthermore, there is disclosed in U.S. Pat. Nos. 4,232,102 and 4,233,383, photoresponsive imaging members comprised of trigonal selenium doped with sodium carbonate, sodium selenite, and trigonal selenium doped with barium carbonate, and barium selenite or mixtures thereof. Moreover, there is disclosed in U.S. Pat. No. 3,824,099, certain photosensitive hydroxy squaraine compositions. According to the disclosure of this patent the squaraine compositions are photosensitive in normal electrostatographic imaging systems.

Also there is disclosed in a copending application the use of known squaraine compositions, such as hydroxy squaraines, as a photoconductive layer in an infrared sensitive photoresponsive device. More specifically there is described in the copending application an improved photoresponsive device containing a substrate, a hole blocking layer, an optional adhesive interfacial layer, an inorganic photogenerating layer, a photoconductive composition capable of enhancing or reducing the intrinsic properties of the photogenerating layer, which photoconductive composition is selected from various squaraine compositions, including hydroxy squaraine compositions, and a hole transport layer.

Addtionally there is disclosed in a copending application the use of novel julolidinyl squaraine compositions, such as bis-9-(8-hydroxyjulolidinyl)squaraine, as photoconductive substances in photoresponsive devices which are sensitive either to infrared light, and/or visible illumination. As indicated in this copending application the improved photoresponsive device in one embodiment is comprised of a supporting substrate, a hole blocking layer, an optional adhesive interfacial layer, an inorganic photogenerating layer, a photoconducting composition capable of enhancing or reducing the intrinsic properties of the photogenerating layer, which composition is comprised of the novel julolidinyl squaraine compositions disclosed therein, and a hole transport layer. The disclosure of the referenced copending application U.S. Ser. No. 493,114/83 is totally incorporated herein by reference.

While squaraine compositions are known, there continues to be a need for novel squaraine compositions, particularly squaraine compositions of superior photosensitivity. Addtionally there continues to be a need for new photoresponsive devices containing as a photoconductive layer new squaraine compositions of matter which are highly photosenstive. Additionally there continues to be a need for novel squaraine materials which when selected for layered photoresponsive imaging devices allow the generation of acceptable images, and wherein such devices can be repeatedly used in a number of imaging cycles without deterioration thereof from the machine environment or surrounding conditions. Moreover, their continues to be a need for improved layered imaging members wherein the squaraine materials selected for one of the layers are substantially inert to users of such devices. Furthermore, their continues to be a need for overcoated photoresponsive devices which are sensitive to a broad range of wavelengths, and more specifically are sensitive to infrared light, and visible light, thereby allowing such devices to be used in a number of imaging and printing systems.

SUMMARY OF THE INVENTION

It is therefore an object of the present invention to provide novel fluorinated squaraine compositions of matter.

In another object of the present invention there are provided improved photoresponsive imaging members containing novel fluorinated squaraine compositions.

It is yet another object of the present invention to provide improved photoresponsive devices which are panchromatic, and thus sensitive to visible light as well as infrared light.

A further specific object of the present invention is the provision of an improved overcoated photoresponsive device containing a photoconductive layer comprised of novel squaraine photosensitive pigments, and a hole transport layer.

It is yet another object of the present invention to provide an improved overcoated photoresponsive device containing a hole transport layer and coated thereover a photoconductive layer containing novel fluorinated squaraine compositions.

In yet another object of the present invention there is provided a photoresponsive device containing a photoconductive composition comprised of novel fluorinated squaraine compositions situated between a hole transport layer, and a photogenerating layer.

It is yet another object of the present invention to provide an improved layered overcoated photoresponsive device containing a novel squaraine photoconductive composition situated between a photogenerating layer, and the supporting substrate of such a device.

Another object of the present invention resides in the provision of an improved overcoated photoresponsive device containing a photogenerating composition situated between a hole transport layer and a photoconductive layer comprised of novel fluorinated squaraine compositions, which device is simultaneously responsive to infrared light and visible light.

Another object of the present invention resides in the provision of an improved overcoated photoresponsive device containing a photoconductive layer comprised of the novel squaraine compositions described herein, situated between a hole transport layer, and a layer comprised of a photogenerating composition, which device is simultaneously responsive to infrared light and visible light.

In yet another object of the present invention there are provided imaging and printing methods with the improved overcoated photoresponsive devices described herein.

In another object of the present invention there are provided processes for obtaining in high yields the novel fluorinated squaraine compositions of the present invention.

These and other objects of the present invention are accomplished by providing novel fluorinated squaraine compositions of matter of the following formula:

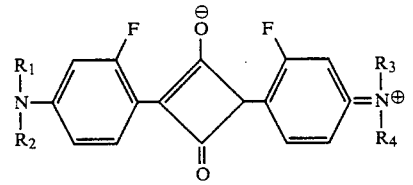

wherein $R_1$, $R_2$, $R_3$, and $R_4$, are independently selected from alkyl groups, containing from about 1 to about 20 carbon atoms. Illustrative examples of alkyl groups include methyl, ethyl, propyl, butyl, pentyl, hexyl, octyl, nonyl, decyl, pentadecyl and the like, with methyl ethyl, propyl, and butyl being preferred. In one specific preferred embodiment of the present invention the alkyl groups are methyl.

Illustrative specific examples of novel fluorinated squaraines included within the scope of the present invention are bis(4-dimethylamino-2-fluorophenyl)-squaraine, bis(4-[N,N,diethylamino-2-fluorophenyl])-squaraine, bis(4-[N-methyl N-ethyl-2-fluoroaniline])-squaraine, bis(4-[N,N-dibenzyl-2-fluoroaniline])- squaraine, bis(4-[N-methyl-N-benzyl-2-fluoroaniline])-squaraine, bis(4-[N-ethyl-N-benzyl-2-fluoroaniline])-squaraine, and the like. Other useful fluorinated squaraine compositions include bis(4-[N,N-di(4-chlorophenylmethyl)-2-fluorophenyl])squaraine, bis(4-[N-methyl-N-(4-chlorophenylmethyl)-2-fluorophenyl])-squaraine, bis(4-[N-ethyl-N-(4-chlorophenylmethyl)-2-fluorophenyl])squaraine and bis(4-[N-benzyl-N-(4-chlorophenylmethyl)-2-fluorophenyl])squaraine.

One preferred squaraine composition included within the scope of the present invention and encompassed by the above-identified formula is bis(4-[dimethylamino-2-fluorophenyl])squaraine.

The novel squaraine compositions disclosed herein are generally prepared by the reaction of an aromatic amine and squaric acid, in a molar ratio of from about 3 to 1 to about 2 to 1, and preferably in a ratio of from about 2 to 1 in the presence of an aliphatic alcohol, and an optional azeotropic cosolvent. About 400 milliliters of alcohol per 0.1 moles of squaric acid are used, however up too 1,000 milliliters of alcohol to 0.1 moles of squaric acid can be used. The reaction is usually accomplished at a temperature of from about 75 degrees Centigrade to about 130 degrees Centigrade, and preferably at a temperature of 95 to 105 degrees Centigrade, with stirring, until the reaction is completed. Subsequently the desired product is isolated from the reaction mixture by known techniques such as filtration, and the product identified by analytical tools including NMR, and mass spectroscopy. Further carbon, hydrogen, fluorine, nitrogen, and oxygen elemental analysis is selected for aiding in identifying the resultant product.

Illustrative examples of amine reactants for preparing the novel squaraines of the present invention include N,N-dimethylamino-3-fluorobenzene, N-methyl-N-ethyl-3-fluoroaniline, N,N-diethyl-3-fluoroaniline, N,N-dibenzyl-3-fluoroaniline, N-methyl-N-benzyl-3-fluoroaniline, N,N-di(4-chlorophenylmethyl)-3-fluoroaniline, and the like. Preferred amine reactants include N,N-dimethyl-3-fluoroaniline.

Illustrative examples of aliphatic alcohols selected for preparing the novel fluorinated squaraines of the present invention include 1-butanol, 1-pentanol, hexanol, and heptanol, while illustrative examples of azeotropic materials that can be used include aromatic compositions such as benzene, toluene, and xylene.

The squaraine compositions of the present invention can also be prepared by the reaction of a dialkyl squarate, and an appropriate aniline, in the presence of a catalyst and an aliphatic alcohol, as described in copending application U.S. Ser. No. the disclosure of which is totally incorporated herein by reference. More specifically this process embodiment comprises reacting at a temperature of from about 60 degrees Centigrade to 160 degrees Centigrade, a dialkyl squarate, with a dialkyl aniline, in the presence of an acid catalyst, and an aliphatic alcohol. Illustrative examples of dialkyl squarate reactants disclosed in the copending application include dimethyl squarate, dipropyl squarate, diethyl squarate, dibutyl squarate, dipentyl squarate, dihexyl squarate, diheptyl squarate, dioctyl squarate, and the like, with the dimethyl, diethyl, dipropyl, and dibutyl squarates being preferred. Illustrative examples of aniline reactants disclosed in the copending application include N,N-dimethylaniline, N,N-diethylaniline, N,N-dipropylaniline, N,N-dibutylaniline, N,N-dipentylaniline, N,N-dihexylaniline, 3-methyl-N,N-dimethylaniline, 3-hydroxy-N,N-dimethylaniline, 3-fluoro-N,N-dimethylaniline, 3-hydroxy-N,N-diethylaniline, 3-ethyl-N,N-dimethylaniline and the like.

The reaction is accomplished in the presence of an acid catalyst, examples of which include various inorganic acids, and organic acids, such as sulfuric acid, trichloroacetic acid, oxalic acid, toluene sulfonic acid, and the like, with sulfuric acid and trichloroacetic being preferred.

Known solvents, such as aliphatic alcohols, including methanol, ethanol, propanol, butanol, especially water saturated 1-butanol, amyl alcohol, and the like are selected for the purpose of forming a solution of the squarate and the acid catalyst. Other solvents can be used providing the objectives of the present invention are accomplished, that is for example wherein such solvents will allow the formation of a homogeneous solution of the dialkyl squarate, and the acid catalyst.

The reaction temperature can vary over a wide range, and is generally dependent on the reactants selected, and other similar factors. Generally, the reaction is accomplished at a temperature at which the aliphatic alcohol boils. Thus, for example, the reaction temperature is generally from about 60 degrees Centigrade to about 160 degrees Centigrade, and is preferably from about 98 degrees Centigrade to about 140 degrees Centigrade, especially when the aliphatic alcohol selected contains a carbon chain length of from about 3 carbon atoms to about 5 carbon atoms.

The amount of reactants and catalyst selected depend on a number of factors, including the specific reactants used, and the reaction temperature involved. Generally, however, from about 5 millimoles, to about 50 millimoles, of dialkyl squarate, with about 10 millimoles to about 100 millimoles of aniline, and from about 5 milliliters to about 50 milliliters of aliphatic alcohol are selected. Also from about 4 millimoles to about 40 millimoles of protons, are contained in the acid catalyst.

The resulting products subsequent to separation from the reaction mixture, by known techniques, including filtration, were identified primarily by melting point data, infrared analysis, and visible absorption spectroscopy. Additionally, the data generated from these techniques was compared with the data available for the identical compounds prepared from the squaric acid process. Further, elemental analysis for the respective substituents, such as analysis for carbon, hydrogen, nitrogen, and fluorine was accomplished.

The improved layered photoresponsive devices of the present invention are comprised in one embodiment of a supporting substrate, a hole transport layer, and as a photoconductive layer situated between the supporting substrate, and the hole transport layer the novel fluorinated squaraine compositions of the present invention. In another embodiment there is envisioned a layered photoresponsive device comprised of a supporting substrate, a photoconductive layer comprised of the novel fluorinated squaraine compositions of the present invention, and situated between the supporting substrate, and the photoconductive layer, a hole transport layer. Also provided in accordance with the present invention are improved photoresponsive device useful in printing systems comprising a layer of a photoconductive composition situated between a photogenerating layer, and a hole transport layer, or wherein the photoconductive composition is situated between a photogenerating layer and the supporting substrate of such a device, the photoconductive composition being comprised of the novel fluorinated squaraine compositions of the present invention. In the latter devices the photoconductive layer serves to enhance, or reduce the intrinisic properties of the photogenerating layer in the infrared and/or visible range of the spectrum.

In one specific illustrative embodiment, the improved photoresponsive device of the present invention is comprised in the order stated of (1) a supporting substrate, (2) a hole blocking layer, (3), an optional adhesive interface layer, (4) an inorganic photogenerator layer, (5) a photoconducting composition layer capable of enhancing or reducing the intrinsic properties of the photogenerating layer, which composition is comprised of the novel squaraine materials described herein, and (6) a hole transport layer. Thus the photoresponsive device of the present invention in one important embodiment is comprised of a conductive supporting substrate, a hole blocking metal oxide layer in contact therewith, an adhesive layer, an inorganic photogenerating material overcoated on the adhesive layer, a photoconducting composition capable of enhancing or reducing the intrinsic properties of the photogenerating layer in the infrared and/or visible range of the spectrum, which composition is comprised of the novel squaraine compositions disclosed herein, and as a top layer, a hole transport layer comprised of certain diamines dispersed in a resinous matrix. The photoconductive layer composition when in contact with the hole transport layer is capable of allowing holes generated by the photogenerating layer to be transported. Further the photoconductive layer does not substantially trap holes generated in the photogenerating layer, and also the photoconductive squaraine composition layer can function as a selective filter, allowing light of a certain wavelength to penetrate the photogenerating layer.

In another important embodiment, the present invention is directed to an improved photoresponsive device as described hereinbefore, with the exception that the photoconductive composition capable of enhancing or reducing the intrinsic properties of the photogenerating layer is situated between the photogenerating layer and the supporting substrate contained in the device. Accordingly, in this variation, the photoresponsive device of the present invention is comprised in the order stated of (1) a substrate, (2) a hole blocking layer, (3) an optional adhesive or adhesion interface layer, (4) a photoconductive composition capable of enhancing or reducing the intrinsic properties of a photogenerating layer in the infrared and/or visible range of the spectrum, which composition is comprised of the novel squaraine materials disclosed herein, (5) an inorganic photogenerating layer, and (6) a hole transport layer.

Exposure to illumination and erasure of the layered photoresponsive devices of the present invention may be accomplished from the front side, the rear side or combinations thereof.

The improved photoresponsive devices of the present invention can be prepared by a number of known methods, the process parameters and the order of coating of the layers being dependent on the device desired. Thus, for example, a three layered photoresponsive device can be prepared by vacuum sublimation of the photoconducting layer on a supporting substrate, and subsequently depositing by solution coating the hole transport layer. In another process variant, the layered photoresponsive device can be prepared by providing the conductive substrate containing a hole blocking layer and an optional adhesive layer, and applying thereto by solvent coating processes, laminating processes, or other methods, a photogenerating layer, a photoconductive composition comprised of the novel squaraines of the present invention, which squaraines are capable of enhancing or reducing the intrinsic properties of the photogenerating layer in the infrared and/or visible range of the spectrum, and a hole transport layer.

In one specific preparation sequence, there is provided a 20 percent transmissive aluminized Mylar substrate, of a thickness of about 3 mils, which is coated with a one-half mil Bird applicator, at about 100 degrees Centigrade with an adhesive, such as the adhesive available from E. I. duPont as 49,000, which adhesive is contained in a trichloroethylene/trichloroethane solvent. Subsequently, there is applied to the adhesive layer a photoconductive layer comprised of the fluorinated squaraines of the present invention, which application is also accomplished with a Bird applicator, with annealing at 135 degrees Centigrade, followed by a coating of the amine transport layer. The amine transport layer is applied by known solution coating techniques, with a 5 mil Bird applicator and annealing at 135 degrees Centigrade wherein the solution contained about 50 weight percent by weight of the amine transport molecule, and 50 weight percent of a resinous binder substance, such as a polycarbonate material.

The improved photoresponsive devices of the present invention can be incorporated into various imaging systems, such as those conventionally known as xerographic imaging processes. Additionally, the improved photoresponsive devices of the present invention containing an inorganic photogenerating layer, and a photoconductive layer comprised of the novel squaraines of the present invention can function simultaneously in imaging and printing systems with visible light and/or infrared light. In this embodiment, the improved photoresponsive devices of the present invention may be negatively charged, exposed to light in a wavelength of from about 400 to about 1,000 nanometers, either sequentially or simultaneously, followed by developing the resulting image and transferring to paper. The above sequence may be repeated many times.

BRIEF DESCRIPTION OF THE DRAWINGS

For a better understanding of the present invention and further features thereof reference is made to the following detailed description of various preferred embodiments wherein.

DESCRIPTION OF THE PREFERRED EMBODIMENTS

The preferred embodiments will now be illustrated with reference to specific photoresponsive devices containing the novel fluorinated squaraine compositions illustrated herein, it being noted that equivalent compositions are also embraced within the scope of the present invention.

Figure 1:
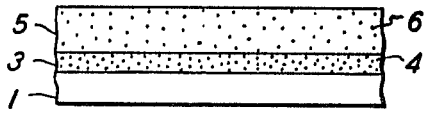
FIG. 1 is a partially schematic cross-sectional view of the photoresponsive device of the present invention.

Illustrated in FIG. 1 is the photoresponsive device of the present invention comprised of a substrate 1, a photoconductive layer 3, comprised of the novel squaraine compositions illustrated herein, especially bis(4-dimethylamino-2-fluorophenyl)squaraine, optionally dispersed in a resinous binder composition 4, and a charge carrier hole transport layer 5, dispersed in an inactive resinous binder composition 6.

Figure 2:
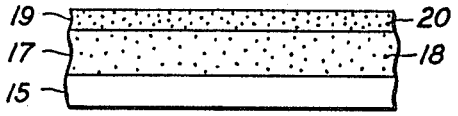
FIG. 2 is a partially schematic cross-sectional view of the photoresponsive device of the present invention.

Illustrated in FIG. 2 is essentially the same device as illustrated in FIG. 1, with the exception that the hole transport layer is situated between the supporting substrate and the photoconductive layer. More specifically with reference to this Figure, there is illustrated a photoresponsive device comprised of a supporting substrate 15, a hole transport layer 17, comprised of a hole transport composition, dispersed in an inert resinous binder composition 18, and a photoconductive layer 19, comprised of the novel squaraine compositions of the present invention, optionally dispersed in a resinous binder composition 20.

Figure 3:
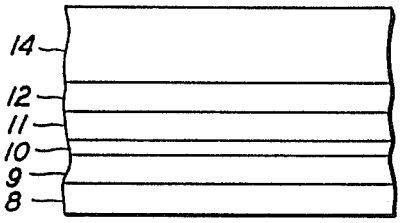
FIGS. 3 and 4 are partially schematic cross-sectional views of photoresponsive devices embraced by the present invention.

Illustrated in FIG. 3 is an improved photoresponsive device of the present invention, comprised of a substrate 8, a hole blocking metal oxide layer 9, an optional adhesive layer 10, a charge carrier inorganic photogenerating layer 11, an organic photoconductive composition layer 12 comprised of the novel squaraine compositions, and capable of enhancing or reducing the intrinsic properties of the photogenerating layer 11 in the infra-red and/or visible range of the spectrum, and a charge carrier, or hole transport layer 14.

Although not specifically illustrated with reference to FIG. 3, nor with references to FIGS. 4–8, the inorganic photogenerating layer, the organic photoconductive layer, and the charge carrier hole transport layer, are comprised of the respective compositions generally dispersed in resinous binder compositions 4 and 6. Thus, for example, the inorganic photogenerating layer, is comprised of an inorganic photogenerating composition as illustrated herein, dispersed in an inactive resinous binder.

Figure 4:
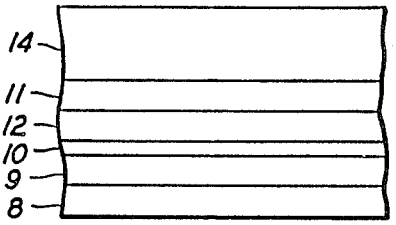

Illustrated in FIG. 4 is essentially the same device as illustrated in FIG. 3 with the exception that the photoconductive layer 12 is situated between the inorganic photogenerating layer 11 and the substrate 8, and more specifically, the photoconductive layer 12 in this embodiment is specifically situated between the optional adhesive layer 10 and the inorganic photogenerating layer 11.

Figure 5:
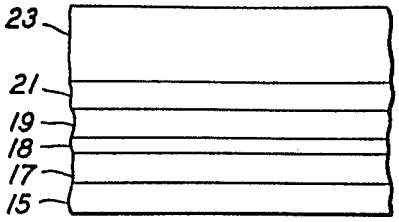
FIG. 5 is a partially schematic cross-sectional view of a preferred photoresponsive device of the present invention.

Illustrated in FIG. 5 is one preferred photoresponsive device of the present invention, wherein the substrate 15 is comprised of Mylar in a thickness of 3 mils, containing a layer of 20 percent transmissive aluminum in a thickness of about 100 Angstroms, a metal oxide layer 17 comprised of aluminum oxide in a thickness of about 20 Angstroms, a polyester adhesive layer 18, which polyester is commercially available from E. I. duPont as 49,000 polyester, this layer being of a thickness of 0.5 microns, an inorganic photogenerating layer 19, of a thickness of about 2.0 microns, and comprised of 10 volume percent of $Na_2SeO_3$ and $Na_2CO_3$ doped trigonal selenium, in a polyvinylcarbazole binder, 90 volume percent, a photoconductive layer 21, in a thickness of about 0.5 microns, and comprised of 30 volume percent of bis(4-dimethylamino-2-fluorophenyl)squaraine, dispersed in the resinous binder Formvar, commercially available from Monsanto Chemical Company 70 volume percent and a hole transport layer 23, in a thickness of about 25 microns, comprised of 50 weight percent of N,N'-diphenyl-N,N'-bis(3-methylphenyl)-[1,1'-biphenyl]-4,4'-diamine, dispersed in a polycarbonate resinous binder.

Figure 6:
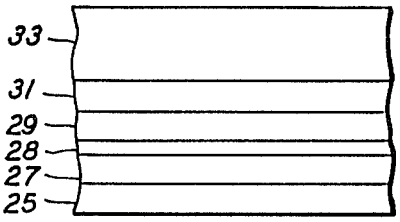
FIG. 6 illustrates a further preferred embodiment of the photoresponsive device of the present invention.

Illustrated in FIG. 6 is another preferred photoresponsive device of the present invention wherein layers 25, 27, 28, 29, and 33 are identical to layers 15, 17, 18, 19, and 23 as described herein with reference to FIG. 5. In FIG. 6 the photoconductive layer 31 rather than being, bis(4-dimethylamino-2-fluorophenyl)squaraine, is bis(4-diethylamino-2-fluorophenyl)squaraine dispersed in the resinous binder Formvar$^R$ 70 volume percent, commercially available from Monsanto Chemical Company.

Figure 7:
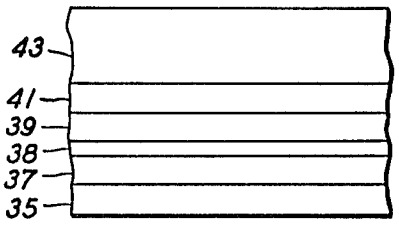
FIG. 7 illustrates another preferred embodiment of the photoresponsive device of the present invention.

Illustrated in FIG. 7 is a further embodiment of the photoresponsive device of the present invention wherein the substrate 35 is comprised of Mylar in a thickness of 3 mils, containing about a 100 Angstrom layer of 20 percent transmissive aluminum, the metal oxide hole blocking layer 37 is aluminum oxide in a thickness of about 20 Angstroms, the optional adhesive layer 38 is a polyester material commercially available from from E. I. duPont as 49,000 polyester, this layer being of a thickness of 0.5 microns, the photogenerating layer 39 is comprised of 33 volume percent of trigonal selenium dispersed in a phenoxy resinous binder, commercially available as the poly(hydroxyether) Bakelite from Allied Chemical Corporation, this layer having a thickness of 0.4 microns, a photoconductive layer 41, comprised of 30 percent by volume of bis(4-dimethylamino-2-fluorophenyl)squaraine, dispersed in 70 percent by volume, of the resinous binder commercially available as Formvar$^R$ from Monsanto Chemical Company, which layer has a thickness of about 0.5 microns and a hole transport layer 43 in a thickness of about 25 microns, comprised of 50 percent by weight of N,N'-diphenyl-N,N'-bis(3-methylphenyl)-[1,1'-biphenyl]-4,4'-diamine, dispersed in 50 percent by weight of a polycarbonate resinous binder.

Figure 8:
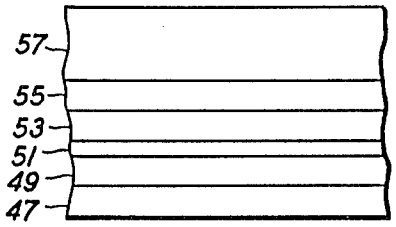
FIG. 8 illustrates another preferred embodiment of the photoresponsive device of the present invention.

Illustrated in FIG. 8 is a further preferred photoresponsive device of the present invention wherein the layers 47, 49, 51, 53, and 57 are identical to the layers 35, 37, 38, 39 and 43, with reference to FIG. 7. In FIG. 8, the photoconductive layer 55 is comprised of 30 volume percent of bis(4-dimethylamino-2-fluoroaniline) squaraine dispersed in a resinous binder Formvar$^R$, 70 volume percent.

With further reference to FIGS. 1 to 8, and especially FIGS. 3 to 8 the substrate layers may be opaque or substantially transparent, and may comprise any suitable material having the requisite mechanical properties. Thus the substrate may comprise a layer of insulating material such as an inorganic or organic polymeric material, including Mylar a commercially available polymer; a layer of an organic or inorganic material having a semi-conductive surface layer such as indium tin oxide, or aluminum arranged thereon, or a conductive material such as, for example, aluminum, chromium, nickel, brass or the like. The substrate may be flexible or rigid and many have a number of many different configurations, such as, for example, a plate a cylindrical drum, a scroll, an endless flexible belt and the like. Preferably, the substrate is in the form of an endless flexible belt. In some situations, it may be desirable to coat on the back of the substrate, particularly when the substrate is an organic polymeric material, an anti-curl layer, such as for example, polycarbonate materials commercially available as Makrolon.

The thickness of the substrate layer depends on many factors, including economical considerations, thus this layer may be of substantial thickness, for example, over 100 mils, or of minimum thickness, providing there are no adverse effects on the system. In one preferred embodiment the thickness of this layer is from about 3 mils to about 10 mils.

The hole blocking metal oxide layers can be comprised of various suitable known materials including aluminum oxide, and the like. The preferred metal oxide layer is aluminum oxide. The primary purpose of this layer is to provide hole blocking, that is to prevent hole injection from the substrate during and after charging. Typically, this layer is of a thickness of less than 50 Angstroms.

The adhesive layers are typically comprised of a polymeric material, including polyesters, polyvinyl butyral, polyvinyl pyrrolidone and the like. Typically, this layer is of a thickness of less than about 0.3 microns.

The inorganic photogenerating layer can be comprised of known photoconductive charge carrier generating materials sensitive to visible light, such as amorphous selenium, amorphous selenium alloys, halogen doped amorphous selenium, halogen doped amorphous selenium alloys, trigonal selenium, mixtures of Groups IA and IIA elements, selenite and carbonates with trigonal selenium, reference U.S. Pat. Nos. 4,232,102 and 4,233,283, the disclosure of each of these patents being totally incorporated herein by reference, cadmium sulphide, cadmium selenide, cadmium telluride, cadmium sulfur selenide, cadmium sulfur telluride, cadmium seleno telluride, copper, and chlorine doped cadmium sulphide, cadmium selenide and cadmium sulphur selenide and the like. Alloys of selenium included within the scope of the present invention include selenium tellurium alloys, selenium arsenic alloys, selenium tellurium arsenic alloys, and preferably such alloys containing a halogen material such as chlorine in an amount of from about 50 to about 200 parts per million.

The photogenerating layer can also contain organic materials including for example, metal phthalocyanines, metal-free phthalocyanines, vanadyl phthalocyanine, and the like. Examples of these phthalocyanine substances are disclosed in U.S. Pat. No. 4,265,990, the disclosure of which is totally incorporated herein by reference. Preferred organic substances for the photogenerating layer include vanadyl phthalocyanine and x-metal-free phthalocyanine.

This layer typically has a thickness of from about 0.05 microns to about 10 microns or more, and preferably is of a thickness from about 0.4 microns to about 3 microns, however, the thickness of this layer is primarily dependent on the photoconductive volume loading, which may vary from 5 to 100 volume percent. Generally, it is desirable to provide this layer in a thickness which is sufficient to absorb about 90 percent or more of the incident radiation which is directed upon it in the imagewise or printing exposure step. The maximum thickness of this layer is dependent primarily upon factors such as mechanical considerations, for example whether a flexible photoresponsive device is desired.

A very important layer of the photoresponsive device of the present invention is the photoconductive layer comprised of the novel squaraine compositions disclosed herein. These compositions which are generally electronically compatible with the charge carrier transport layer, enable photoexcited charge carriers to be injected into the transport layer, and further allow charge carriers to travel in both directions across the interface between the photoconductive layer and the charge transport layer.

Generally, the thickness of the photoconductive layer depends on a number of factors including the thicknesses of the other layers, and the percent mixture of photoconductive material contained in this layer. Accordingly, this layer can range in thickness of from about 0.05 microns to about 10 microns when the photoconductive squaraine composition is present in an amount of from about 5 percent to about 100 percent by volume, and preferably this layer ranges in thickness of from about 0.25 microns to about 1 micron, when the photoconductive squaraine composition is present in this layer in an amount of 30 percent by volume. The maximum thickness of this layer is dependent primarily upon factors such as mechanical considerations, for example whether a flexible photoresponsive device is desired.

The inorganic photogenerating materials or the photoconductive materials can comprise 100 percent of the respective layers, or these materials can be dispersed in various suitable inorganic or resinous polymer binder materials, in amounts of from about 5 percent by volume to about 95 percent by volume, and preferably in amounts of from about 25 percent by volume to about 75 percent by volume. Illustrative examples of polymeric binder resinous materials that can be selected include those as disclosed, for example, in U.S. Pat. No. 3,121,006, the disclosure of which is totally incorporated herein by reference, polyesters, polyvinyl butyral, Formvar$^R$, polycarbonate resins, polyvinyl carbazole, epoxy resins, phenoxy resins, especially the commercially available poly(hydroxyether)resins, and the like.

In one embodiment of the present invention, the charge carrier transport material, such as the diamine described hereinafter, may be incorporated into the photogenerating layer, or into the photoconductive layer in amounts, for example, ranging from about zero volume percent to 60 volume percent.

The charge carrier transport layers, such as layer 14, can be comprised of a number of suitable materials which are capable of transporting holes, this layer generally having a thickness in the range of from about 5 microns to about 50 microns, and preferably from about 20 microns to about 40 microns. In a preferred embodiment, this transport layer comprises molecules of the formula:

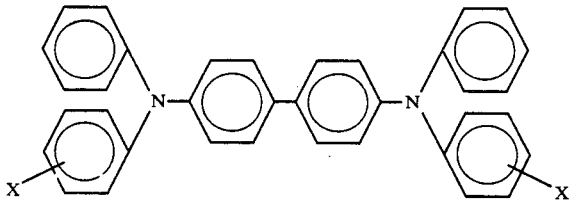

dispersed in a highly insulating and transparent organic resinous binder wherein X is selected from the group consisting of (ortho) $CH_3$, (meta) $CH_3$, (para) $CH_3$, (ortho) Cl, (meta) Cl, (para) Cl. The highly insulating resin, which has a resistivity of at least $10^{12}$ ohm-cm to prevent undue dark decay, is a material which is not necessarily capable of supporting the injection of holes from the photogenerating layer, and is not capable of allowing the transport of these holes through the material. However, the resin becomes electrically active when it contains from about 10 to 75 weight percent of the substituted N,N,N',N'-tetraphenyl[1,1-biphenyl]4-4'-diamines corresponding to the foregoing formula.

Compounds corresponding to the above formula include, for example, N,N'-diphenyl-N,N'-bis(alkylphenyl)-[1,1-biphenyl]-4,4'-diamine wherein the alkyl is selected from the group consisting of methyl such as 2-methyl, 3-methyl and 4-methyl, ethyl, propyl, buyl, hexyl and the like. With chloro substitution, the amine is N,N'-diphenyl-N,N'-bis(halo phenyl)-[1,1'-biphenyl]-4,4'-diamine wherein halo is 2-chloro, 3-chloro or 4-chloro.

Other electrically active small molecules which can be dispersed in the electrically inactive resin to form a layer which will transport holes include, bis(4-diethylamine-2-methylphenyl) phenylmethane; 4',4''-bis(diethylamino)-2'2''-dimethyltriphenyl methane; bis-4 (diethylamino phenyl) phenylmethane; and 4,4'-bis (diethylamino)-2,2'-dimethyl triphenylmethane.

Providing the objectives of the present invention are achieved, other charge carrier transport molecules can be selected for the photoconductive device of the present invention.

Examples of the highly insulating and transparent resinous material or inactive binder resinous material, for the transport layers include materials such as those described in U.S. Pat. No. 3,121,006 the disclosure of which is totally incorporated herein by reference. Specific examples of organic resinous materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binder materials are polycarbonate resins having a molecular weight (Mw) of from about 20,000 to about 100,000 with a molecular weight in the range of from about 50,000 to about 100,000 being particularly preferred. Generally, the resinous binder contains from about 10 to about 75 percent by weight of the active material corresponding to the foregoing formula, and preferably from about 35 percent to about 50 percent of this material.

With further specific reference to the three layered devices illustrated in FIGS. 1 and 2, the supporting substrate, the hole transport layer, the photoconductive layer, and the resinous binder compositions, as well as the thicknesses thereof, are as described herein. More specifically, for example, the supporting substrate layers 1 and 15 may be opaque or substantially transparent and may comprise a suitable material having the requisite mechanical properties. Thus this substrate may comprise a layer of insulating material such as an inorganic or organic polymeric material, a layer of an organic or inorganic material having a conductive surface layer thereon, or a conductive material such as, for example, aluminum, chromium, nickel, indium, tin oxide, brass or the like. Also there can be coated on the substrate as optional layers known hole blocking layers, such as aluminum oxide and an adhesive material, such as a polyester resin, commercially available for example from Goodyear Chemical Company. The substrate may be flexible or rigid and may have any of many different configurations, such as for example, a plate, a cylindrical drum, a scroll, an endless flexible belt and the like. Preferably, this substrate is in the form of an endless flexible belt. When in the configuration of a belt, in some instances it may be desirable to apply a coating of an adhesive layer to the selected substrate, of the device of FIG. 1, for example, subsequent to the application of a hole blocking layer, such as aluminum oxide.

The photoconductive layers 3 and 19 respectively, are comprised of the novel fluoroinated squaraine compositions of the present invention, especially bis(4-dimethylamino-2-fluorophenyl)squaraine, optionally dispersed in a resinous binder composition, 4 and 20. These squaraines are electronically compatible with the charge transport layer, thus allowing photoexcited charge carriers to be injected into the transport layer, and charge carriers to travel in both directions across the interface between the charge transport layer and the photogenerating layer.

The photoconductive squaraine pigments of the present invention are generally dispersed in a resinous binder materials 4 or 20, such as various suitable inorganic or organic binder compositions, in amounts of from about 5 percent by volume to 95 percent by volume, and preferably in amounts of from about 25 percent by volume to about 75 percent by volume. Illustrative examples of polymeric resinous binder materials that can be selected include those as disclosed, for example, in U.S. Pat. No. 3,121,006, the disclosure of which is totally incorporated herein by reference, polyesters, polyvinylbutyral, Formvar$^R$, polycarbonate resins, especially those commercially available as Makrolon$^R$, polyvinyl carbazoles, epoxy resins, phenoxy resins, commercially available as poly(hydroxyether) resins, and the like.

The hole transport layers, 5, and 17, are as illustrated herein with reference to FIGS. 3 to 8.

Also included within the scope of the present invention are methods of imaging with the photoresponsive devices illustrated herein. These methods of imaging generally involve the formation of an electrostatic latent image on the imaging member, followed by developing the image with known developer compositions, subsequently transferring the image to a suitable substrate and permanently affixing the image thereto. In those environments wherein the device is to be used in a printing mode, the imaging method involves the same steps with the exception that the exposure step is accomplished with a laser device, or image bar, rather than a broad spectrum white light source. In the later embodiment a photoresponsive device is selected that is sensitive to infrared illumination.

The invention will now be described in detail with reference to specific preferred embodiments thereof, it being understood that these examples are intended to be illustrative only. The invention is not intended to be limited to the materials, conditions, or process parameters recited herein, it being noted that all parts and percentages are by weight unless otherwise indicated.

EXAMPLE I

In a 1,000 milliliter, 3-necked round bottom flask equipped with a magnetic stirrer, thermometer, Dean-Stark trap and condenser, and blanketed with argon was added 5.7 grams, 0.05 moles, of squaric acid, 13.7 grams of 3-fluoro-N,N-dimethylaniline, 0.1 moles, 200 milliliters of benzene and 400 milliliters of n-butanol. The mixture was then allowed to reflux for 24 hours, and the resulting heterogeneous product was allowed to cool to room temperature.

There resulted the blue crystalline pigment bis(4-dimethylamino-2-fluorophenyl)squaraine, subsequent to filtration, which substance was collected on a fritted glass filter funnel. Subsequently, the squaraine product was washed with 100 milliliters of acetone, resulting in 1.0 grams of product.

The resulting squaraine was then subjected to standard elemental analysis with the following results:

Calculated: C, 67.4; H, 5.1; N, 7.9; F, 10.7. Found: C, 67.4; H, 5.1; N, 7.9; F, 10.5.

Infrared analysis indicated the following:

(IR)(KBR): 1595 centimeters-1

EXAMPLE II

In a 1,000 milliliter, 3-necked round bottom flask equipped with a magnetic stir bar, thermometer, Dean-Stark trap and condenser, and blanketed with argon was added 5.7 grams, 0.05 moles, of squaric acid, 230 milliliters of toluene and 230 milliliters of n-butanol. The mixture was heated to reflux for 45 minutes, causing all the squaric acid to dissolve into the solution mixture. To the heated solution there was then added 13.7 grams of 3-fluoro-N,N-dimethylaniline, and there resulted immediately a blue colored solution. Thereafter, the reaction mixture was reflxed for 24 hours, followed by allowing the heterogeneous product to cool to room temperature.

There was collected on a fritted glass filter funnel a blue crystalline pigment identified in accordance with the procedure of Example I, as bis(4-dimethylamino-2-fluorophenyl) squaraine. Washing of this product was effected with ethylacetate, resulting in 0.7 grams of product.

There was prepared a photoresponsive device containing as the photoconductive material the squaraine as prepared in accordance with Example I, and as a charge transport layer an amine dispersed in a resinous binder. Specifically, there was prepared a photoresponsive device by providing a ball grained aluminum substrate, of a thickness of 150 microns, followed by applying thereto with a multiple clearance film applicator, in a wet thickness of 0.5 mils, a layer of N-methyl-3-aminopropyltrimethoxysilane, available from PCR Research Chemicals, Florida, in ethanol, in a 1:20 volume ratio. This layer was then allowed to dry for 5 minutes at room temperature, followed by curing for 10 minutes at 110° C. in a forced air oven.

A photoconductive layer containing 30 percent by weight of bis(4-dimethylamino-2-fluorophenyl)-squaraine was then prepared as follows:

In separate 2 oz. amber bottles there was added 0.33 grams of the above squaraine, 0.75 grams of Vitel PE-200$^R$, a polyester available from Goodyear, 85 grams of ⅛" stainless steel shot, and 20 ml of methyl ethyl ketone/toluene solvent mixture, in a 4:1 volume ratio. The above mixtures were placed on a ball mill for 24 hours. The resulting slurry was then coated on the aluminum substrate with a multiple clearance film applicator, to a wet thickness of 1 mil. The layer was then allowed to air dry for 5 minutes. The resulting device was then dried at 135° C. for 6 minutes in a forced air oven. The dry thickness of the squaraine layer was 1 micron.

The above photoconductive layer was then overcoated with a charge transport layer, which was prepared as follows:

A transport layer composed of 50 percent by weight Makrolon$^R$, a polycarbonate resin available from Larbensabricken Bayer A.G., was mixed with 50 percent by weight N,N'-bis(3-methylphenyl)-1,1'-biphenyl-4,4'-diamine. This solution was mixed to 9 percent by weight in methylene chloride. All of these components were placed in an amber bottle and dissolved. The mixture was coated to give a layer with a dry thickness of 30 microns on top of the above squaraine photoconductive layer, using a multiple clearance film applicator (15 mils wet gap thickness). The resulting device was then air dried at room temperature for 20 minutes, followed by drying in a forced air oven at 135° C. for 6 minutes.

The above photoreceptor device was then incorporated into a xerographic imaging test fixture, and there resulted subsequent to development with toner particles containing a styrene n-butylmethacrylate resin, copies of excellent resolution and high quality.

EXAMPLE III

A photoreceptive device was prepared by providing an aluminized Mylar substrate in a thickness of 3 mils, and applying thereto a layer of 0.5 percent by weight of duPont 49,000 adhesive, a polyester available from duPont, in methylene chloride and 1,1,2-trichloroethane (4:1 volume ratio) with a Bird Applicator, to a wet thickness of 0.5 mils. The layer was allowed to dry for one minute at room temperature, and 10 minutes at 100° C. in a forced air oven. The resulting layer had a dry thickness of 0.05 microns.

A photogenerator layer containing 10 percent by volume of trigonal selenium, 25 percent by volume of N,N'-diphenyl-N,N'-bis(3-methylphenyl)1,1'-biphenyl-4,4'-diamine, and 65 volume percent of polyvinylcarbazole was then prepared as follows:

In a 2 oz. amber bottle was added 0.8 grams of polyvinylcarbazole and 14 milliliters, 1:1 volume ratio, tetrahydrofuran:toluene. There was then added to this solution 3.8 grams of trigonal selenium, and 100 grams ⅛" stainless steel shot. The above mixture was then placed on a ball mill for 72 to 96 hours. Subsequently, 5 grams of the resulting slurry were added to a solution of 0.18 grams of polyvinylcarbazole, and 0.15 grams of N,N'-diphenyl-N,N'-bis(3-methylphenyl)1,1'-biphenyl-4,4'-diamine, in 6.3 milliliters of tetrahydrofuran:toluene, volume ratio 1:1. This slurry was then placed on a shaker for 10 minutes. The resulting slurry was then coated on the above polyester interface with a Bird applicator, wet thickness of 0.5 mil and the resulting layer was then dried at 135° C. for 6 minutes in a forced air oven, resulting in a dry thickness of 2.0 microns.

A photoconductive layer containing 30 percent by weight of bis(4-dimethylamino-2-fluorophenyl) squaraine was then prepared by repeating the procedure of Example II, which layer was coated on the above photogenerator layer with a Bird applicator.

The above photoconductive layer was then overcoated with a charge transport layer which was prepared as follows:

A transport layer comprised of 50 percent by weight Makrolon ®, a polycarbonate resin available from Larbensabricken Bayer A.G, was mixed with 50 percent by weight N,N'-bis(3-methylphenyl)-1,1'-biphenyl-4,4'-diamine. This solution was mixed to 9 percent by weight of methylene chloride. All of these components were placed into an amber bottle and dissolved. Subsequently, the resulting mixture was coated to give a layer with a dry thickness of 30 microns on top of the above photoconductive squaraine layer, which coating was accomplished with a multiple clearance film applicator, 15 mils wet gap thickness. The resulting device was then dried in air at room temperature for 20 minutes and then in a forced air oven at 135° C. for 6 minutes.

There resulted a photoresponsive device containing an aluminized Mylar supporting substrate, a photogenerating layer of trigonal selenium, a photoconductive layer of bis(4-dimethylamino-2-fluorophenyl) squaraine and as a top layer a charge transport layer of the amine indicated.

Other photoresponsive devices are also prepared by repeating the procedure of Example II, and Example III with the exception that there was selected as the photogenerating layer a selenium tellurium alloy, containing 75 percent by weight of selenium and 25 percent by weight of tellurium, or an arsenic selenium alloy, containing 99.99 percent by weight of selenium and 0.1 percent by weight of arsenic.

The devices as prepared in Examples II and III were then tested for photosensitivity in the visible infrared region of the spectrum by negatively charging the devices with corona to 0.800 volts, followed by simultaneously exposing each device to monochromic light in the wavelength region of about 400 to about 1,000 nanometers. The photoresponsive device of Example II responded primarily to light in the wavelength region of 400 to 700 nanometers, indicating visible photosensitivity, while the device of Example IV had excellent response in the wavelength region of from about 400 to about 950 nanometers, indicating both visible and infrared photosensitivity for this device.

Moreover, the photoresponsive device as prepared in accordance with Example III and IV was incorporated into a xerographic imaging test fixture and there results subsequent to development with toner particles containing a styrene n-butylmethacrylate resin, copies of excellent resolution and high quality.

EXAMPLE IV

There was prepared bis(4-dimethylamino-2-fluorophenyl) squaraine, by the reaction of a dialkyl squarate and 3-fluoro-N,N-dimethylaniline.

Di-n-butyl squarate, 1.13 grams, 5 millimoles, was dissolved in 5 milliliters of water saturated 1-butanol containing 0.1 milliliters of concentrated sulfuric acid, in a 100 milliliter 3-neck flask, equipped with a magnetic stir bar and a nitrogen inlet. This mixture was stirred and allowed to reflux under an inert atmosphere, by maintaining an oil bath containing the 3-neck flask, at a temperature of from 120 degrees Centigrade to 130 degrees Centigrade. Subsequently 1.40 grams, of 3-fluoro-N,N-dimethylaniline was added to the reaction mixture through a pressure equalizing funnel, over a period of about 7 to 8 hours, 2 drops every 30 minutes. At the end of this period, the solution turned a light green in color. Refluxing was continued for about 24 hours, and the reaction material was cooled to room temperature, at which time there was added 2 milliliters of triethylamine, and 30 milliliters of an ether/methanol mixture, 1:1 ratio. The resulting precipitated product was isolated from the reaction mixture by filtration through a medium sintered glass funnel followed by washing with an ether/methanol solution, 1:1 ratio, until the filtrate was light blue in color. There was obtained about 0.34 grams, 19 percent yield, bis(4-dimethylamino-2-fluorophenyl) squaraine as confirmed by elemental carbon, hydrogen, nitrogen and fluorine analysis, absorption spectroscopy, infrared analysis, and mass spectrum analysis. Additionally, the melting point of this material was 273 degrees Centigrade.

Calculated for $C_{20}H_{18}N_2O_2F_2$: C, 67.44; H, 5.09; N, 7.87; F, 10.67.

Found: C, 67.58; H, 5.35, N, 7.79; F, 10.81.

Although the invention has been described with reference to specific preferred embodiments, it is not intended to be limited thereto, rather those skilled in the art will recognize variations and modifications may be made therein which are within the spirit of the present invention and within the scope of the following claims.

I claim:

1. Photoresponsive fluorinated squaraine compositions of the following formulas:

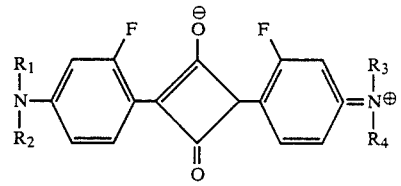

wherein $R_1$, $R_2$, $R_3$, and $R_4$, are independently selected from alkyl groups, containing from about 1 to about 20 carbon atoms.

2. A fluorinated squaraine composition in accordance with claim 1 wherein $R_1$, $R_2$, $R_3$ and $R_4$ are alkyl groups containing from about one carbon atom to about 10 carbon atoms.

3. A fluorinated squaraine composition in accordance with claim 1 wherein $R_1$, $R_2$, $R_3$ and $R_4$ are selected from the group consisting of methyl, ethyl, propyl, butyl and pentyl.

4. The photoresponsive squaraine composition bis(4-[dimethylamino-2-fluorophenyl]) squaraine.

5. The photoresponsive squaraine composition bis(4-N,N-diethylamino-2-fluorophenyl)squaraine.

6. An improved photoresponsive device comprised in the order stated of (1) a supporting substrate, (2) a photoconductive layer comprised of the fluorinated squaraine compositions of claim 1, and (3) a diamine hole transport layer.

7. An improved photoresponsive device comprised in the order stated of (1) a supporting substrate, (2) a diamine hole transport layer, and (3) a photoconductive layer comprised of the squaraine compositions of claim 1.

8. An improved photoresponsive device in accordance with claim 6 wherein the fluorinated squaraine is bis(4-dimethylamino-2-fluorophenyl)squaraine.

9. An improved photoresponsive device in accordance with claim 7 wherein the fluorinated squaraine is bis(4-dimethylamino-2-fluorophenyl)squaraine.

10. An improved photoresponsive device in accordance with claim 6 wherein the supporting substrate is aluminum, or an organic polymeric composition.

11. An improved photoresponsive device in accordance with claim 7 wherein the supporting substrate is aluminum, or an organic polymeric composition.

12. An improved photoresponsive device in accordance with claim 6 wherein the fluorinated squaraine composition is dispersed in a resinous binder in an amount of from about 5 percent by volume to about 95 percent by volume, and the diamine hole transport material is dispersed in a resinous binder in an amount of from about 10 percent by weight to about 75 percent by weight.

13. An improved photoresponsive device in accordance with claim 7 wherein the fluorinated squaraine composition is dispersed in a resinous binder in an amount of from about 5 percent by volume to about 95 percent by volume, and the diamine hole transport material is dispersed in a resinous binder in an amount of from about 10 percent by weight to about 75 percent by weight.

14. An improved photoresponsive device in accordance with claim 12 wherein the resinous binder for the squaraine composition is a polyester, polyvinylbutyral polyvinylcarbazole, or a phenoxy resin, and the resinous binder for the diamine hole transport material is a polycarbonate, a polyester, or a vinyl polymer.

15. An improved photoresponsive device in accordance with claim 13 wherein the resinous binder for the squaraine composition is a polyester, polyvinylbutyral polyvinylcarbazole, or a phenoxy resin, and the resinous binder for the diamine hole transport material is a polycarbonate, a polyester, or a vinyl polymer.

16. An improved photoresponsive device in accordance with claim 6 wherein the diamine composition comprises molecules of the formula:

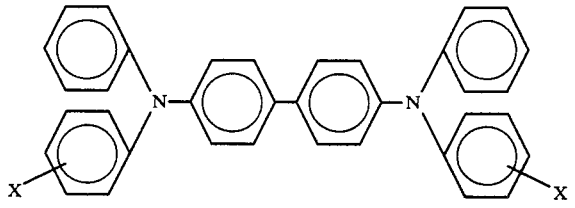

dispersed in a highly insulating and transparent organic resinous binder wherein X is selected from the group consisting of ortho ($CH_3$), meta ($CH_3$), para ($CH_3$), ortho (Cl), meta (Cl), or para (Cl).

17. An improved photoresponsive device in accordance with claim 7 wherein the diamine composition comprises molecules of the formula:

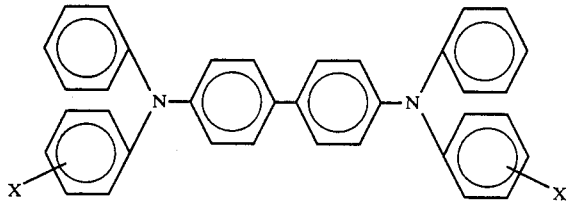

dispersed in a highly insulating and transparent organic resinous binder wherein X is selected from the group consisting of ortho ($CH_3$), meta ($CH_3$), para ($CH_3$), ortho (Cl), meta (Cl), or para (Cl).

18. An improved photoresponsive device in accordance with claim 16 wherein the diamine is comprised of N,N'-diphenyl-N,N'-bis(3-methylphenyl)[1,1-biphenyl]-4,4'-diamine.

19. An improved photoresponsive device in accordance with claim 17 wherein the diamine is comprised of N,N'-diphenyl-N,N'-bis(3-methylphenyl)[1,1-biphenyl]-4,4'-diamine.

20. An improved photoresponsive device comprised in the order stated of the following layers, (1) a supporting substrate, (2) a metal oxide hole blocking layer, (3) an optional adhesive layer, (4) an inorganic photogenerating layer, (5) a photoconductive composition comprised of the fluorinated squaraine compositions of claim 1, and (6) a diamine hole transport layer.

21. An improved photoresponsive device comprised in the order stated of the following layers, (1) a supporting substrate, (2) a metal oxide hole blocking layer, (3) an optional adhesive layer, (4) a photoconductive composition comprised of the fluorinated squaraine compositions of claim 1, (5) an inorganic photogenerating layer, and (6) a diamine hole transport layer.

22. An improved photoresponsive device in accordance with claim 20 wherein the fluorinated squaraine composition is bis(4-dimethylamino-2-fluorophenyl)-squaraine.

23. An improved photoresponsive device in accordance with claim 21 wherein the fluorinated squaraine composition is bis(4-dimethylamino-2-fluorophenyl)-squaraine.

24. An improved photoresponsive device in accordance with claim 20 wherein the supporting substrate is comprised of a conductive metallic substance, or an insulating polymeric composition optionally containing on its surface a semiconductive material.

25. An improved photoresponsive device in accordance with claim 21 wherein the supporting substrate is comprised of a conductive metallic substance, or an insulating polymeric composition optionally containing on its surface a semiconductive material.

26. An improved photoresponsive device in accordance with claim 24 wherein the conductive substrate is aluminum, and the semiconductive material is transmissive aluminum, or indium tin oxide.

27. An improved photoresponsive device in accordance with claim 25 wherein the conductive substrate is aluminum, and the semiconductive material is transmissive aluminum, or indium tin oxide.

28. An improved photoresponsive device in accordance with claim 20 wherein the diamine composition comprises molecules of the formula:

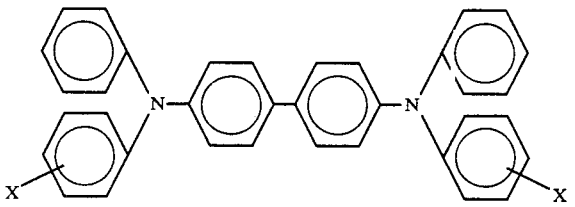

dispersed in a highly insulating and transparent organic resinous material wherein X is selected from the group consisting of ortho ($CH_3$), meta ($CH_3$), para ($CH_3$), ortho (Cl), meta (Cl), or para (Cl).

29. An improved photoresponsive device in accordance with claim 21 wherein the diamine composition comprises molecules of the formula:

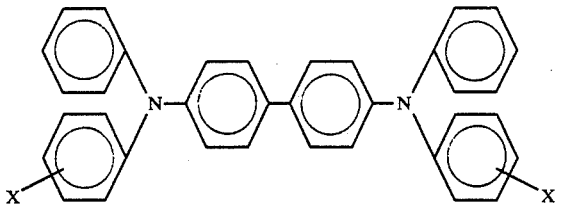

dispersed in a highly insulating and transparent organic resinous material wherein X is selected from the group consisting of ortho ($CH_3$), meta ($CH_3$), para ($CH_3$), ortho (Cl), meta (Cl), or para (Cl).

30. An improved photoresponsive device in accordance with claim 28 wherein the resinous binder for the diamine hole transport material is a polycarbonate, a polyester, or a vinyl polymer.

31. An improved photoresponsive device in accordance with claim 29 wherein the resinous binder for the diamine hole transport material is a polycarbonate, a polyester, or a vinyl polymer.

32. An improved photoresponsive device in accordance with claim 28 wherein the diamine is comprised of N,N'-diphenyl-N,N'-bis(3-methylphenyl)-[1,1-biphenyl]-4,4'-diamine.

33. An improved photoresponsive device in accordance with claim 29 wherein the diamine is comprised of N,N'-diphenyl-N,N'-bis(3-methylphenyl-[1,1-biphenyl]-4,4'-diamine.

34. An improved photoresponsive device in accordance with claim 20 wherein the photogenerating layer is comprised of selenium, a halogen doped selenium substance, selenium alloys, or halogen doped selenium alloys.

35. An improved photoresponsive device in accordance with claim 21 wherein the photogenerating layer is comprised of selenium, a halogen doped selenium substance, selenium alloys, or halogen doped selenium alloys.

36. An improved photoresponsive device in accordance with claim 34 wherein the selenium alloy is comprised of selenium tellurium, selenium arsenic, or selenium tellurium arsenic.

37. An improved photoresponsive device in accordance with claim 35 wherein the selenium alloy is comprised of selenium tellurium, selenium arsenic, or selenium tellurium arsenic.

38. An improved photoresponsive device in accordance with claim 34 wherein the selenium alloy is doped with chlorine in an amount of from about 50 ppm to about 200 ppm.

39. An improved photoresponsive device in accordance with claim 35 wherein the selenium alloy is doped with chlorine in an amount of from about 50 ppm to about 200 ppm.

40. An improved photoresponsive device in accordance with claim 20 wherein the photogenerating layer is trigonal selenium.

41. An improved photoresponsive device in accordance with claim 21 wherein the photogenerating layer is trigonal selenium.

42. An improved photoresponsive device in accordance with claim 20 wherein the photogenerating layer is comprised of $Na_2SeO_3$ and $Na_2CO_3$ doped with trigonal selenium.

43. An improved photoresponsive device in accordance with claim 21 wherein the photogenerating layer is comprised of $Na_2SeO_3$ and $Na_2CO_3$ doped with trigonal selenium.

* * * * *